US010843847B2

(12) United States Patent
Septien-Rojas

(10) Patent No.: US 10,843,847 B2
(45) Date of Patent: Nov. 24, 2020

(54) POWDER-RESISTANT RECLOSURE

(71) Applicant: ILLINOIS TOOL WORKS INC., Glenview, IL (US)

(72) Inventor: Jose Manuel Septien-Rojas, Scarborough (GB)

(73) Assignee: ILLINOIS TOOL WORKS INC., Glenview, IL (US)

( * ) Notice: Subject to any disclaimer, the term of this patent is extended or adjusted under 35 U.S.C. 154(b) by 35 days.

(21) Appl. No.: 15/557,190

(22) PCT Filed: Apr. 27, 2016

(86) PCT No.: PCT/US2016/029505
§ 371 (c)(1),
(2) Date: Sep. 11, 2017

(87) PCT Pub. No.: WO2016/176295
PCT Pub. Date: Nov. 3, 2016

(65) Prior Publication Data

US 2018/0044067 A1 Feb. 15, 2018

Related U.S. Application Data

(60) Provisional application No. 62/154,167, filed on Apr. 29, 2015.

(51) Int. Cl.
*B65D 33/25* (2006.01)
*A44B 19/16* (2006.01)

(52) U.S. Cl.
CPC ..... *B65D 33/2508* (2013.01); *B65D 33/2558* (2013.01); *A44B 19/16* (2013.01); *Y10T 24/2532* (2015.01)

(58) Field of Classification Search
CPC ..... Y10T 24/2532; Y10T 24/2534; B65D 33/2591; B65D 33/2508; B65D 33/2558; B65D 33/01; A44B 19/16
See application file for complete search history.

(56) References Cited

U.S. PATENT DOCUMENTS 5,273,511 A * 12/1993 Boeckman ..... B29C 66/346 156/251
5,829,884 A * 11/1998 Yeager ..... B65D 33/01 383/45

(Continued)

FOREIGN PATENT DOCUMENTS

JP 2005270475 10/2005

OTHER PUBLICATIONS

International Search Report issue in PCT/US2016/029505 dated Jul. 4, 2016.

*Primary Examiner* — Victor D Batson
*Assistant Examiner* — Michael S Lee
(74) *Attorney, Agent, or Firm* — McCarter & English LLP

(57) ABSTRACT

The disclosure pertains to powder-resistant profiles for zippers or reclosures, such as may be used for reclosable packages. A first profile includes a first upper interlocking profile and a first lower interlocking profile, The second profile includes a second upper interlocking profile and a second lower interlocking profile. The first upper and lower interlocking profiles may include male elements while the second upper and lower interlocking profiles may include complementary female elements. A first central area is termed between the first upper and lower interlocking profiles and a second central area is formed between the second upper and lower interlocking profiles. The first and second central areas include respective first and second series of apertures through the male elements to allow powder otherwise trapped between the first and second profiles to escape or exit therethrough.

19 Claims, 4 Drawing Sheets

(56) References Cited

U.S. PATENT DOCUMENTS

| | | | | |
|---|---|---|---|---|
| 6,299,353 | B1 * | 10/2001 | Piechocki | B65D 33/2558 24/324 |
| 6,955,465 | B2 | 10/2005 | Machacek et al. | |
| 7,437,805 | B2 * | 10/2008 | Berich | B65D 33/01 24/399 |
| 8,061,898 | B2 * | 11/2011 | Pawloski | B65D 33/01 24/399 |
| 8,250,718 | B2 * | 8/2012 | Greco | B65D 33/2508 24/400 |
| 10,118,737 | B2 * | 11/2018 | Septien Rojas | B65D 33/2508 |
| 2003/0095727 | A1 | 5/2003 | Leighton | |
| 2008/0232722 | A1 * | 9/2008 | Pawloski | B65D 33/01 383/64 |
| 2009/0300891 | A1 * | 12/2009 | Nanba | B65D 33/2508 24/399 |
| 2012/0301056 | A1 * | 11/2012 | Anzini | B29D 5/10 383/61.2 |

* cited by examiner

POWDER-RESISTANT RECLOSURE

This application is a National Phase Application of PCT International Application No.: PCT/US2016/029505, filed on Apr. 27, 2016 which claims priority under 35 U.S.C. 119(e) of U.S. provisional application Ser. No. 62/154,167, filed on Apr. 29, 2015, the contents of which is hereby incorporated by reference in its entirety and for all purposes.

BACKGROUND OF THE DISCLOSURE

Field of the Disclosure

The disclosure pertains to powder-resistant profiles for zippers or reclosures, such as may be used for reclosable packages, particularly polymeric reclosable packages.

Description of the Prior Art

The prior art of powder-resistant reclosures for reclosable packages is well-developed for its purposes. In particular, some reclosures have apertures passing through the base of the female profile only. However, further improvements are sought in such zipper or reclosure products.

The prior art, such as the VECTOR® product, includes multiple alignment reclosures, meaning that the tracks on the reclosure halves can mate in any one of a number of alignments and typically have at least three reclosure elements. The multiple-alignment capability further allows a single half of a reclosure to be folded back on to itself so that it can mate with itself (i.e., it can self-mate).

Prior art includes U.S. Pat. No. 6,955,465 entitled "Powder-Resistant Flexible Zipper for Reclosable Packaging", issued on Oct. 18, 2005 to Machacek et al. and U.S. Pat. No. 6,299,353 entitled "Zipper For Reclosable Container With Apertures Passing Through Female Profile", issued on Oct. 9, 2001 to Piechocki et al.

OBJECTS AND SUMMARY OF THE DISCLOSURE

It is therefore an object of the present disclosure to provide improvements in powder-resistant zipper or reclosure for reclosable packages.

This and other objects are attained in a zipper embodiment, wherein the portions removed from the male profile could be located in the middle of the base of the male profile, on other positions on the male elements, or on other positions on the profile. The use of two complete male interlocking elements would typically maintain a reasonably good opening force. In a multiple alignment embodiment, engagement hooks would be used rather than separate male or female profiles. In some multiple alignment embodiments, the engagement hooks may be all male elements or a mix of male and female elements on both profiles.

The intermittent cut-outs and/or cavities (gaps) in the reclosure range also help to stop any unwanted opening propagation when some particles still block a small part of the profile leaving a small section unclosed.

In a typical embodiment, all four flanges of the reclosure or zipper are sealed to the walls of the reclosable package. This means that powder going inside the apertures does not return back to the product volume of the reclosable package. However, this is not considered to be an obstacle because the quantity of powder entering the apertures during the usage of the bag should not overfill the available space within the reclosure or zipper. However, in some embodiments, this may be a concern. In such embodiments, only the top flanges would be sealed and the bottom flanges would be unsealed thereby allowing powder to pass through the apertures and then through the unsealed portion between the bottom flange and the package wall, thereby returning to the product volume.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
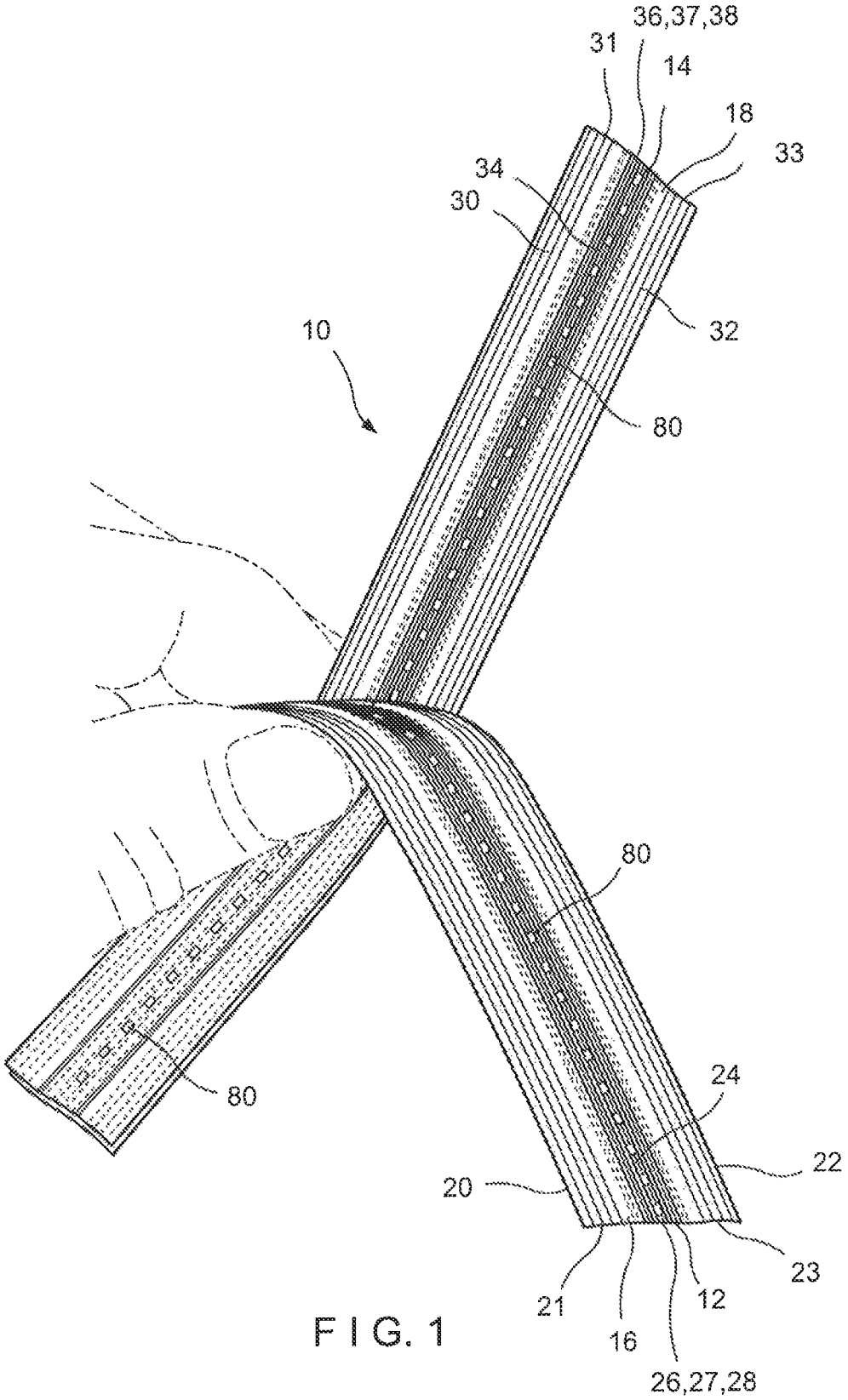
FIG. 1 is a perspective view of an embodiment of the reclosure or zipper of the present disclosure, shown in a partially closed (interlocked) and partially open (non-interlocked) configuration.
Figure 2:
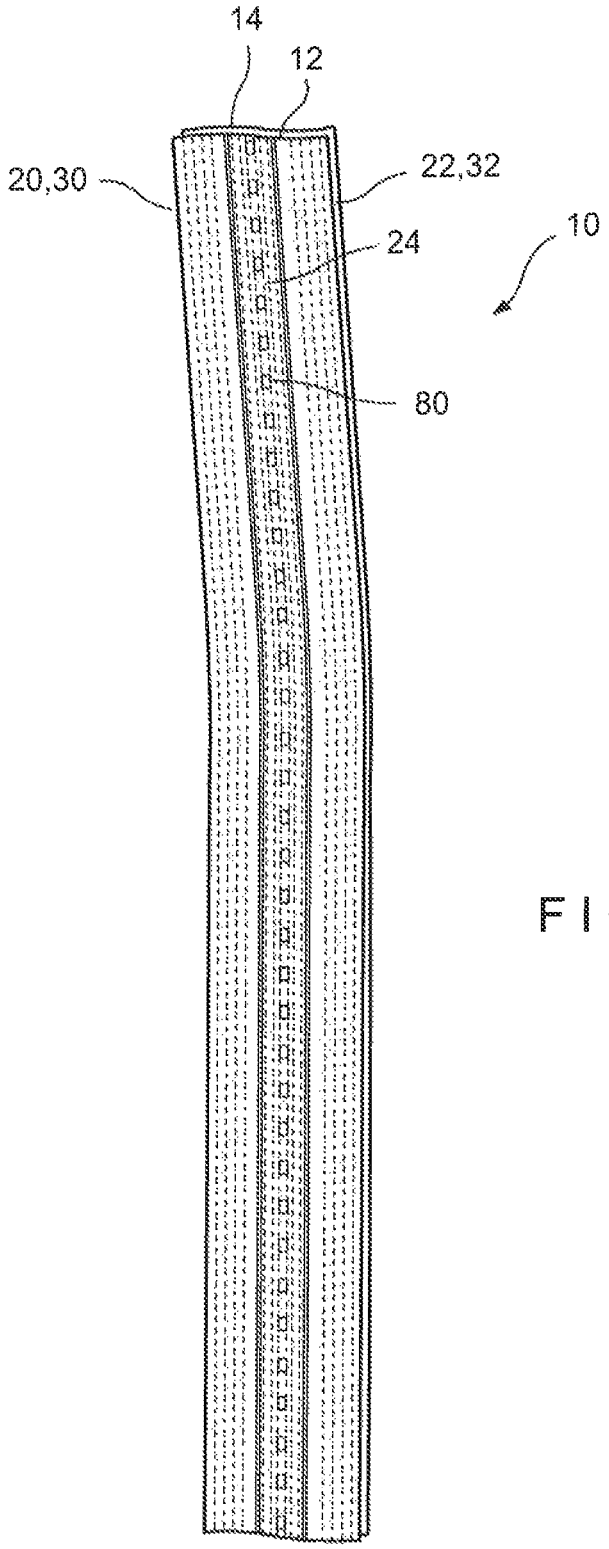
FIG. 2 is a perspective view of an embodiment of the reclosure or zipper of the present disclosure, shown in a closed or interlocked configuration.
Figure 3A:
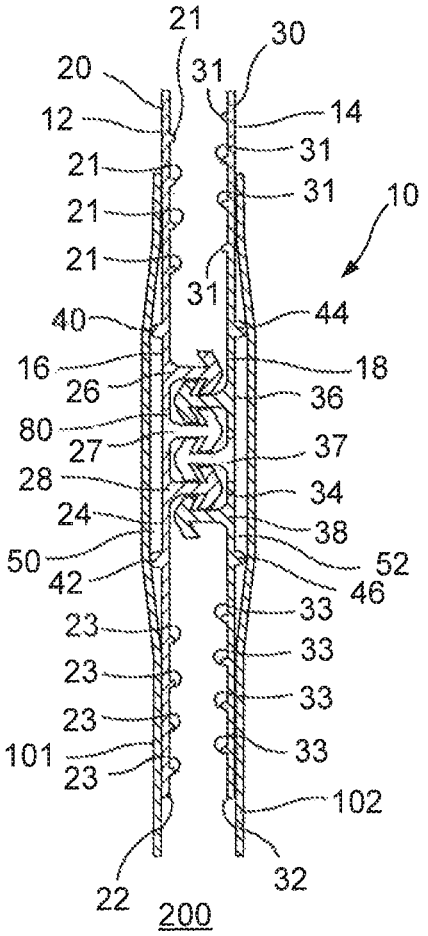
FIG. 3A is a cross-sectional view of an embodiment of the reclosure or zipper of the present disclosure, shown with the upper and lower flanges sealed to the bag or container walls.
Figure 3B:
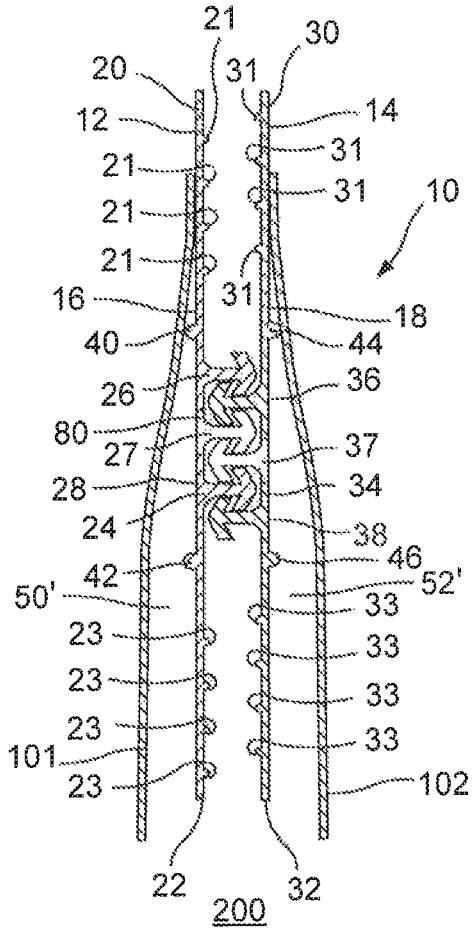
FIG. 3B is a cross-sectional view of an embodiment of the reclosure or zipper of the present disclosure, shown with the upper flanges sealed to the bag or container walls and the lower flanges unsealed to the bag or container walls.
Figure 4:
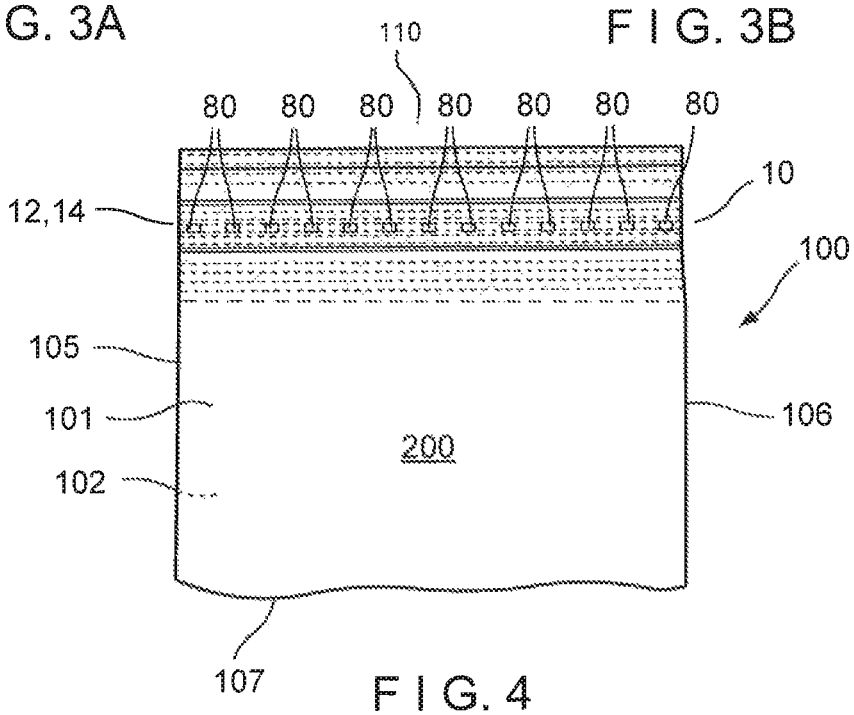
FIG. 4 is a plan view of a bag or container, including an embodiment of the reclosure or zipper of the present disclosure.

Referring now to the drawings wherein like numerals refer to like elements throughout the several views, one sees that FIGS. 1, 2, 3A and 3B illustrate the zipper 10 (which may be implemented as a reclosure or a VECTOR® product) which includes first and second zipper profiles 12, 14 which are constructed upon respective first and second base elements 16, 18. Typically, all elements of the zipper 10 are made from a polymeric material. As shown in FIG. 4, the zipper 10 is particularly adapted to be used as part of a polymeric reclosable package or bag 100. As shown in FIGS. 3A and 3B, the first base element 16 forms first upper flange 20 and first lower flange 22. Likewise, the second base element 18 forms second upper flange 30 and second lower flange 32. As can be seen best from FIGS. 3A and 3B, the interior facing wall of first upper flange 20 includes first upper inner spacer elements 21 which are longitudinally oriented inwardly extending protrusions which prevent or minimize the sealing of the zipper profiles 12, 14 to each other during sealing operations with respect to the walls 101, 102 (see FIG. 4) of the package or bag 100. Similarly, the interior facing wall of first lower flange 22 includes first lower inner spacer elements 23, the interior facing wall of second upper flange 30 includes second upper inner spacer elements 31, and the interior facing wall of second lower flange 32 includes second lower inner spacer elements 33.

The first base element 16 includes a first central area 24 between the first upper flange 20 and the first lower flange 22. Likewise, the second base element 18 includes a second central area 34 between the second upper flange 30 and the second lower flange 32. As can be seen best in FIGS. 3A and 3B, in the illustrated embodiment, self-mating male arrowhead elements 26, 27, 28 extend perpendicularly from first central area 24 and self-mating male arrowhead elements 36, 37, 38 extend perpendicularly from second central area 34. The self-mating male arrowhead elements are all similarly configured with a stem and with laterally extending detent elements. The laterally extending detent elements from each zipper profile detent engage or interlock with corresponding laterally extending detent elements from the opposing zipper profile. The configuration of first zipper profile 12 is substantially identical, or a mirror image of, the configuration of second zipper profile 14. In fact, both zipper profiles 12, 14 could be formed from the same length of profile material. Additionally, this configuration allows for a multiple alignment zipper in that the self-mating arrowhead elements can be offset by one or even two elements (up or down in the illustrated orientation of FIGS. 3A and 3B) and still achieve an interlocking configuration.

Figure 5A:
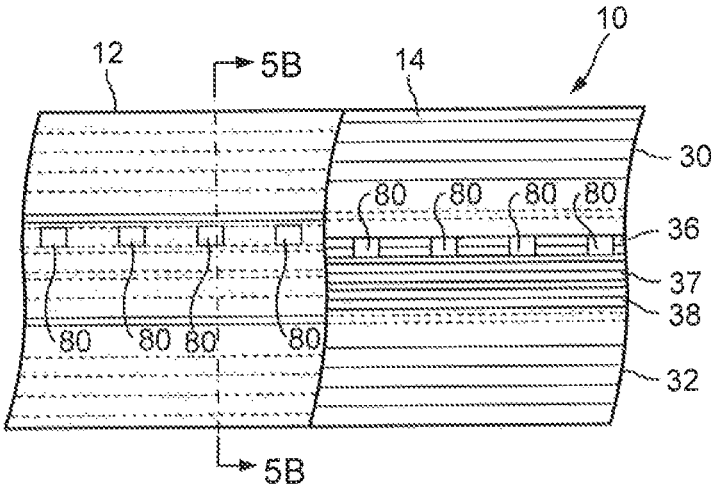
FIG. 5A is a plan, partially cut-away view, showing a first embodiment of the present disclosure.
Figure 5B:
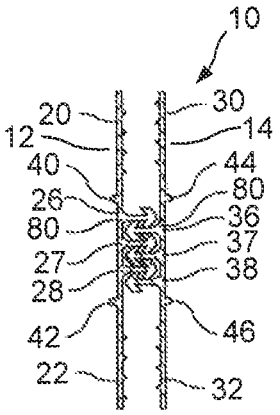
FIG. 5B is a cross-sectional view along plane 5B-5B of FIG. 5A.
Figure 6A:
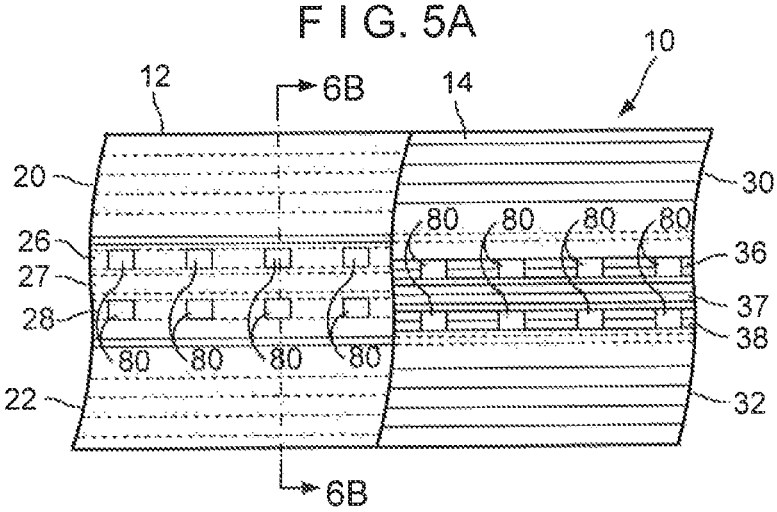
FIG. 6A is a plan, partially cut-away view, showing a second embodiment of the present disclosure.
Figure 6B:
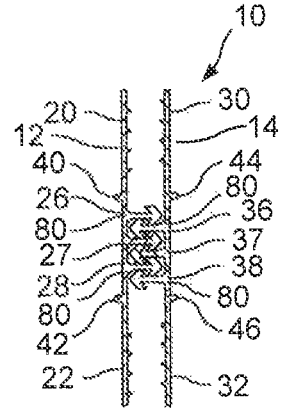
FIG. 6B is a cross-sectional view along plane 6B-6B of FIG. 6A.
Figure 7A:
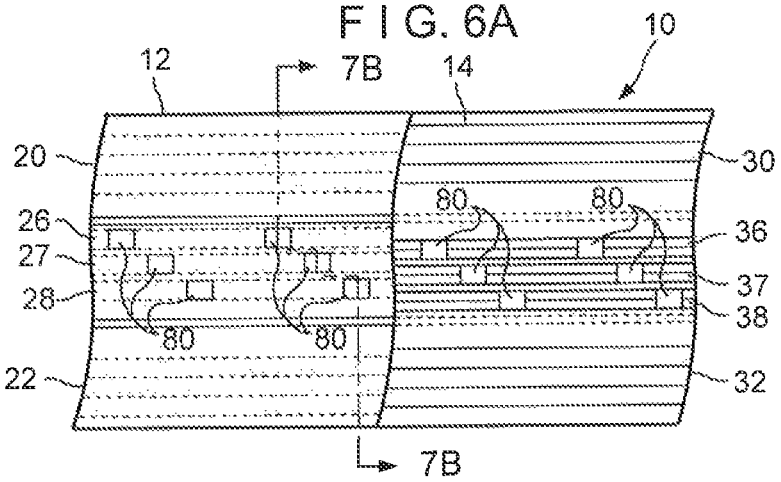
FIG. 7A is a plan, partially cut-away view, showing a third embodiment of the present disclosure.
Figure 7B:
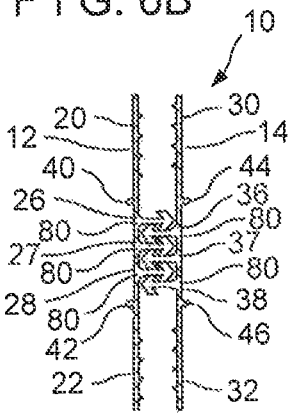
FIG. 7B is a cross-sectional view along plane 7B-7B of FIG. 7A.

The self-mating male arrowhead elements 26, 27, 28 and 36, 37, 38 extend the longitudinal length of the respective interlocking zipper profile 12, 14. In FIGS. 3A and 3B, portions of the central male arrowhead elements 27, 37 (and the underlying first or second central area 24, 34) are periodically, systematically or randomly (including irregularly and pseudo-randomly) removed to form apertures 80. Similarly, as shown in FIGS. 5A, 5B, 6A, 6B, 7A and 7B, portions of the self-mating male arrowhead elements 26, 27, 28, 36, 37, 38 and the underlying first or second central areas 24, 34 may be periodically, systematically or randomly (including irregularly or pseudo-randomly) removed to create apertures 80 which pass through the respective interlocking profile and which may be likewise formed at regular or irregular intervals. These apertures 80 may be created or formed on one or more male arrowhead elements or be any combination of the various configurations. In FIGS. 5A and 5B, it is shown that apertures 80 may be formed periodically along a single self-mating male arrowhead element 26, 36 of each respective interlocking zipper profile 12, 14. In FIGS. 6A and 6B, it is shown that the apertures 80 may be formed periodically along the two outer self-mating male arrowhead elements 26, 28 and 36, 38 of each interlocking zipper profile 12, 14 while leaving the central self-mating male arrowhead element 27, 37 intact. Likewise, in FIGS. 7A and 7B, it is shown that apertures 80 may be formed along each self-mating male arrowhead element 26, 27, 28 and 36, 37, 38 wherein the apertures 80 on one arrowhead element are longitudinally offset with respect to apertures 80 on an adjacent arrowhead element on the same interlocking zipper profile 12, 14.

As shown in FIGS. 3A and 3B, a first upper outer spacer element 40 is formed on the outer portion of first base element 16 near the intersection of the first upper flange 20 and the first central area 24. A first lower spacer element 42 is formed on the outer portion of first base element 16 near the intersection of the first lower flange 22 and the first central area 24. Likewise, a second upper outer spacer element 44 is formed on the outer portion of the second base element 18 near the intersection of the second upper flange 30 and the second central area 34 and a second lower outer spacer element 46 is formed on the outer portion of the second base element 18 near the intersection of the second lower flange 32 and the second central area 34. Outer spacer elements 40, 42 and 44, 46 serve to space the respective first and second interlocking zipper profiles 12, 14 from the respective first and second bag walls 101, 102 of the bag 100 so that the first and second central areas 24, 34 are not sealed to the respective first and second bag walls 101, 102. In FIG. 3A, wherein the first upper and lower flanges 20, 22 and the second upper and lower flanges 30, 32 are sealed to respective first and second bag walls 101, 102, first and second volumes 50, 52 are created between the first interlocking zipper profile 12 and the first bag wall 101 and between the second interlocking zipper profile 14 and the second bag wall 102. The apertures 80, formed by a removal of a portion of central self-mating male arrowhead elements 27 and 37, provide inlet ports for powder or similar material otherwise trapped between the first and second interlocking zipper profiles 12, 14 to pass to the first and second volumes 50, 52. In the embodiment of FIG. 3A, powder going through the apertures 80 does not return back to the product volume 200 of the reclosable package. However, this is not considered to be an obstacle because the quantity of powder entering the apertures 80 during the typical usage of the bag 100 may not overfill the first and second volumes 50, 52 formed between the first central area 24 and the first bag wall 101 and between the second central area 34 and the second bag wall 102. However, in some embodiments or some applications, this may be a concern, and the embodiment of FIG. 3B may be considered.

In FIG. 3B, wherein the first and second upper flanges 20, 30 are sealed to the respective first and second bag walls 101, but first and second lower flanges 22, 32, are free of sealing, a conduit is created through apertures 80 to the respective first and second passageways 50', 52' created between respective first and second interlocking zipper profiles 12, 14 and respective first and second bag walls 101, 102. This allows for powder or similar material otherwise trapped between first and second zipper profiles 12, 14 to pass through the apertures 80 and passageway 50', 52' to return to the product volume 200 of bag 100.

In either the arrangement of FIG. 3A or FIG. 3B, zipper 10 is sealed across the mouth 110 formed across the width of first and second bag walls 101, 102 as shown in FIG. 4. First and second bag walls 101, 102 are sealed to each other along side seals 105, 106 and bottom seal 107 thereby forming a reclosable package 100 with product volume 200.

Thus the several aforementioned objects and advantages are most effectively attained. Although preferred embodiments of the invention have been disclosed and described in detail herein, it should be understood that this invention is in no sense limited thereby.

What is claimed is:

1. A zipper or reclosure comprising:

a first profile and a second profile;

the first profile including a first base and at least three first interlocking elements, the at least three first interlocking elements including respective first stems extending away from the first base and terminating in respective first arrowhead elements;

the second profile including a second base and at least three second interlocking elements, the at least three second interlocking elements including respective second stems extending away from the second base and terminating in respective second arrowhead elements;

the first and second interlocking elements including a plurality of apertures passing through at least a portion of at least one of the first and second arrowhead elements and through the respective first and second bases.

2. The zipper of claim 1 wherein at least a portion of the plurality of apertures pass through at least a portion of the first and second stems.

3. The zipper of claim 1 wherein the first interlocking elements are substantially identical to the second interlocking elements.

4. The zipper of claim 3 wherein the zipper is a self-mating zipper.

5. The zipper of claim 3 wherein the zipper is a multiple alignment zipper.

6. The zipper of claim 3 wherein the apertures are formed as discontinuities in at least a portion of the arrowhead elements of the first and second interlocking elements.

7. The zipper of claim 6 wherein apertures are formed on an arrowhead element of a single first interlocking element and an arrowhead element of a single second interlocking element.

8. The zipper of claim 6 wherein apertures are formed on arrowhead elements of two non-adjacent first interlocking elements and arrowhead elements of two non-adjacent second interlocking elements.

9. The zipper of claim 8 wherein apertures on an arrowhead element of an interlocking element are longitudinally offset of apertures formed on an adjacent arrowhead element of an interlocking element on a same profile.

10. The zipper of claim 6 wherein the apertures are formed at regular intervals.

11. The zipper of claim 6 wherein the apertures are formed at irregular intervals.

12. The zipper of claim 6 wherein apertures are formed on arrowhead elements of adjacent first interlocking elements and arrowhead elements of adjacent second interlocking elements.

13. The zipper of claim 1 wherein the first base includes a first upper flange, a first lower flange, and a first central area between the first upper and lower flanges; and the second base includes a second upper flange, a second lower flange and a second central area between the second upper and lower flanges.

14. The zipper of claim 13 wherein at least one of the first upper flange, the first lower flange, the second upper flange and the second lower flange include longitudinally oriented inner spacer elements on an inner wall thereof.

15. The zipper of claim 13 wherein the first and second bases include respective first and second spacer elements on an outer wall thereof for forming respective first and second volumes between the first and second profiles and respective first and second bag walls, the apertures providing a conduit to the first and second volumes.

16. The zipper of claim 13 wherein the first interlocking element is formed on the first central area and the second interlocking element is formed on the second central area.

17. The zipper of claim 16 wherein the first interlocking element includes a first number of interlocking elements and the second interlocking element includes a second number of interlocking elements.

18. The zipper of claim 17 wherein the first number is equal to the second number.

19. The zipper of claim 18 wherein the zipper is a self-mating zipper.

* * * * *